US005724949A

United States Patent [19]

Liang

[11] Patent Number: 5,724,949

[45] Date of Patent: Mar. 10, 1998

[54] HYDRAULIC DRIVE FOR A PRESSURE WAVE SUPERCHARGER UTILIZED WITH AN INTERNAL COMBUSTION ENGINE

[75] Inventor: Cho Y. Liang, Peoria, Ill.

[73] Assignee: Caterpillar Inc., Peoria, Ill.

[21] Appl. No.: 744,551

[22] Filed: Nov. 6, 1996

[51] Int. Cl.[6] ..... F02B 33/42; F02B 39/08

[52] U.S. Cl. ..... 123/559.2; 123/561

[58] Field of Search ..... 123/559.1, 559.2, 123/561

[56] References Cited

U.S. PATENT DOCUMENTS

| | | | |
|---|---|---|---|
| 3,296,791 | 1/1967 | Richard et al. | 123/561 |
| 4,206,607 | 6/1980 | Heberle et al. | 123/559.2 |
| 4,563,997 | 1/1986 | Aoki | 123/559.2 |
| 5,421,310 | 6/1995 | Kapich | 123/561 |

FOREIGN PATENT DOCUMENTS

| | | | |
|---|---|---|---|
| 151407 | 8/1985 | European Pat. Off. | 123/559.2 |
| 2-204629 | 8/1990 | Japan | 123/559.2 |

*Primary Examiner*—Michael Koczo
*Attorney, Agent, or Firm*—Fred J. Baehr

[57] ABSTRACT

A hydraulic drive system for a pressure wave supercharger having a circular array of elongated chambers disposed to form a rotor rotatably disposed in a housing, the pressure wave supercharger being cooperatively associated with an internal combustion engine, and the hydraulic drive system comprising at least one hydraulic pump, a hydraulic motor driven by hydraulic fluid supplied by the hydraulic pump and coupled to the rotor and a control valve for regulating the speed of the hydraulic motor and the rotor to synchronize the pressure wave action within the elongated chambers of the rotor and supply combustion air to the engine at the proper volume and density at various operating conditions.

4 Claims, 6 Drawing Sheets

HYDRAULIC DRIVE FOR A PRESSURE WAVE SUPERCHARGER UTILIZED WITH AN INTERNAL COMBUSTION ENGINE

TECHNICAL FIELD

The invention relates to a pressure wave supercharger and more particularly to a hydraulic drive for rotating a rotor portion of a pressure wave supercharger relative to a stationary housing portion to synchronize the wave action within the rotor portion.

BACKGROUND ART

Pressure wave superchargers utilized with internal combustion engines, particularly diesel engines, are adapted to use exhaust gases from the engine to produce a pressure wave that compresses combustion air in a plurality of elongated chambers disposed in a circular array to form a rotor, which is adapted to be rotatably disposed in a housing. The rotor is rotated relative to the housing to synchronize the wave action within the elongated chambers. Low pressure combustion air enters one end of the rotating elongated chambers. High pressure exhaust gases enter the other end of the rotating elongated chambers producing a pressure wave within the elongated chambers which compresses the combustion air and as the chambers rotate about their central axis. The compressed combustion air is discharged from the same end of the elongated chamber that it entered. The compressed combustion air is supplied to an intake manifold of the internal combustion engine. As the elongated chambers rotate the exhaust gas at a lower pressure leaves the same end of the elongated chambers that it entered and is discharged to the atmosphere.

U.S. Pat. No. 4,563,997 describes a control system utilizing an electronic control unit which responds to various engine conditions to regulate the speed of an electric motor or variable speed belt drive which rotates the rotor of a pressure wave supercharger at the proper speed to achieve optimum supercharging pressure for operating the engine.

SUMMARY OF THE INVENTION

Among the objects of the invention may be noted the provision of a variable speed drive system for a pressure wave supercharger to synchronize the wave action within the supercharger to provide the necessary combustion air to achieve maximum engine efficiency as the engine operates at required speeds and loads.

In general, a hydraulic drive system for a pressure wave supercharger when made in accordance with this invention, comprises a circular array of a plurality of elongated chambers forming a rotor, which is rotatably disposed within a housing. The pressure wave supercharger is cooperatively associated with an internal combustion engine to compress incoming combustion air supplied to the engine. The hydraulic drive system is characterized by an hydraulic motor coupled to the rotor to rotate the rotor relative to the housing, an hydraulic pump for providing pressurized hydraulic fluid to the hydraulic motor to drive the motor. A control valve to regulates the flow of hydraulic fluid provided to the hydraulic motor and to control the speed of the rotor to synchronize the pressure wave action within the elongated chambers of the rotor and supply combustion air to the engine at the proper volume and density at various operating conditions.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
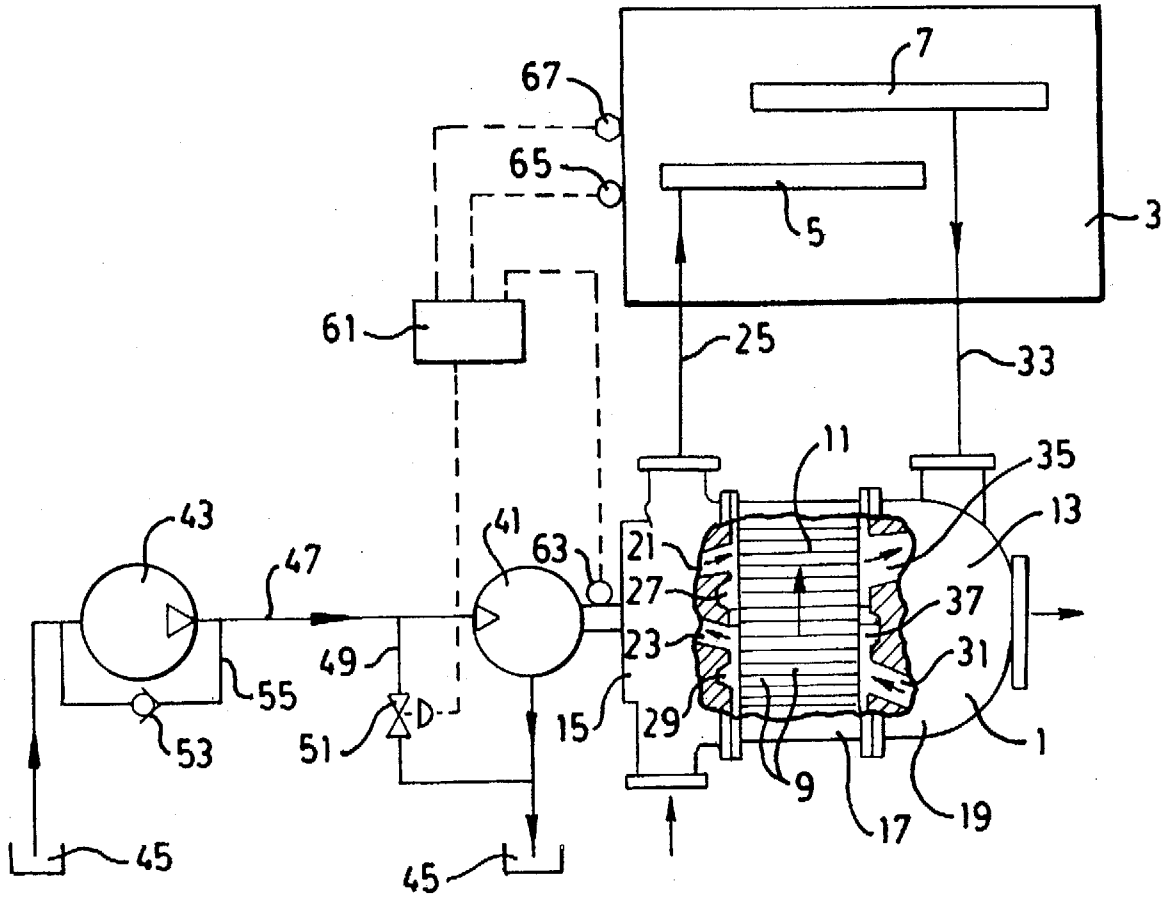
FIG. 1 is a schematic view of a hydraulic drive system for a pressure wave supercharger utilized with an internal combustion made in accordance with this invention.

Referring now to the drawings in detail and in particular to FIG. 1 there is shown a hydraulic drive system for a pressure wave supercharger 1 utilized with internal combustion engine 3 having a combustion air or inlet manifold 5 and an exhaust gas or exhaust manifold 7.

The pressure wave supercharger 1 comprises a circular array of a plurality of elongated chambers 9 forming a rotor 11, which is rotatably disposed within a housing 13. The housing 13 comprises an inlet end portion 15 for handling combustion air, a central portion 17 enclosing the rotor 11, and an exhaust end portion 19 for handling exhaust gases from the internal combustion engine 3.

The inlet end portion 15 has an low pressure combustion air duct 21 disposed in fluid communication with one end of plurality of the elongated chambers 9 and with the atmosphere, and a high pressure combustion air duct 23 disposed in fluid communication with the one end of a different plurality of the elongated chambers 9 and with the inlet manifold 5 via a combustion air conduit 25. Disposed between the low and high pressure ducts 21 and 23, respectively, in the housing 13 is an expansion pocket 27 and disposed in the housing adjacent and below the high pressure combustion air duct 23 is a compression pocket 29.

The exhaust end portion 19 of the housing 13 has a high pressure exhaust duct 31 disposed in fluid communication with another end of a plurality of the elongated chambers and the exhaust manifold 7 via a exhaust gas conduit 33, and a low pressure exhaust duct 35 disposed in fluid communication with the other end of a different plurality of the elongated chambers 9 and with the atmosphere. Disposed within the outlet end portion 19 of the housing 13 between the high and low pressure exhaust ducts 31 and 35, respectively, and in fluid communication with the other end of a plurality of the elongated chambers 9 is a gas pocket 37.

The pressure wave supercharger 1 is, thus, cooperatively associated with an internal combustion engine 3 to compress incoming combustion air supplied to the engine 3 utilizing exhaust gases to produce pressure waves within the elongated chambers 9 to compress the incoming combustion air. To synchronize the action of the pressure wave within the elongated chambers 9, the rotor 11 is rotated at speeds tuned to operating conditions of the engine 3 by a variable speed hydraulic motor 41 coupled to the rotor 11 to rotate the rotor 11 relative to the housing 13.

A hydraulic pump 43, driven by the engine 3, takes its suction from a hydraulic fluid reservoir or sump 45 and provides pressurized hydraulic fluid to operate the variable speed hydraulic motor 41 via a hydraulic conduit 47. A bypass conduit 49 and a control valve 51 are disposed to bypass hydraulic fluid supplied by to pump 43 around the motor 41 and into the hydraulic fluid sump or reservoir 45 to regulate the speed of the hydraulic motor 41 and control the speed of the rotor 11 of the pressure wave supercharger 1. The hydraulic pump 43 is preferably a positive displacement pump, therefore, a pressure relief valve 53 set at a predetermined pressure cooperates with a return conduit 55 to return hydraulic fluid to the suction end of the pump 43 when the pressure in the conduit 47 exceeds the preset pressure set on the pressure relief valve 53.

An electronic controller 61 receives signals from a supercharger rotor speed sensor 63, an engine speed sensor 65 and other engine condition sensors 67 which may include fuel rate, boost pressure, intake manifold temperature or throttle position. In response thereto, the controller 61 regulates the control valve 51 to bypass hydraulic fluid around the variable speed hydraulic motor 41 to the sump 45 to control the speed thereof and the speed of the supercharger rotor 11. The speed of the rotor 11 is tuned to engine operating conditions to achieve maximum efficiency of the engine 3.

Figure 2:
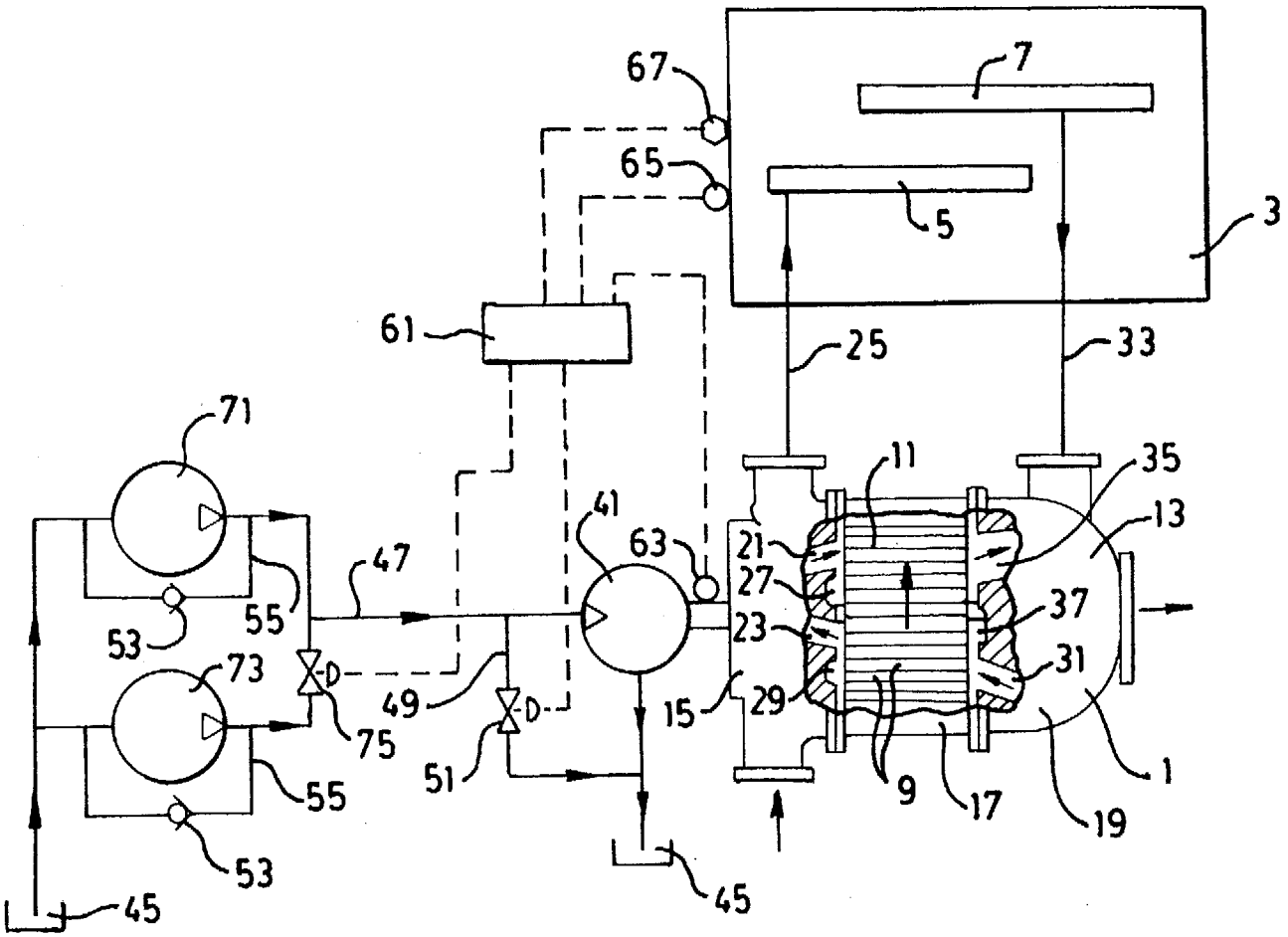
FIG. 2 is a schematic view of an alternative hydraulic drive system for a pressure wave supercharger utilized with an internal combustion engine made in accordance with this invention.

Referring now to FIG. 2 in detail, the supercharger 1, the engine 3, the hydraulic motor 41 and the controller 61 are the same as described in FIG. 1, the difference in the figures being that in FIG. 2 there are two hydraulic pumps, a main hydraulic pump 71 and an auxiliary hydraulic pump 73 connected in parallel to the hydraulic conduit 47 to supply hydraulic fluid to drive the variable speed hydraulic motor 41. The main hydraulic pump 71 supplies hydraulic fluid to the variable speed hydraulic motor 41 during the entire time the engine 3 is operating and the auxiliary hydraulic pump 73 only supplies hydraulic fluid to the hydraulic motor during low engine speed operation or when operating below a predetermined speed. The controller 61 operates the control valve 51 as shown in FIG. 1 and when the engine speed is above a predetermined level or at such a speed that the output of the main pump 71 is sufficient to operate the variable speed hydraulic motor 41 at required operating speeds, a valve 75 is by the controller 61 to shut off the flow of hydraulic fluid from the auxiliary pump 73 to the hydraulic motor 41. Shutting down the auxiliary pump 73 with the valve 75 shows the function schematically. However, it is understood that this functional means for shutting off the flow of hydraulic fluid from the auxiliary pump 73 may comprise a clutch or a valve to bypass the fluid to the sump 45.

Figure 3:
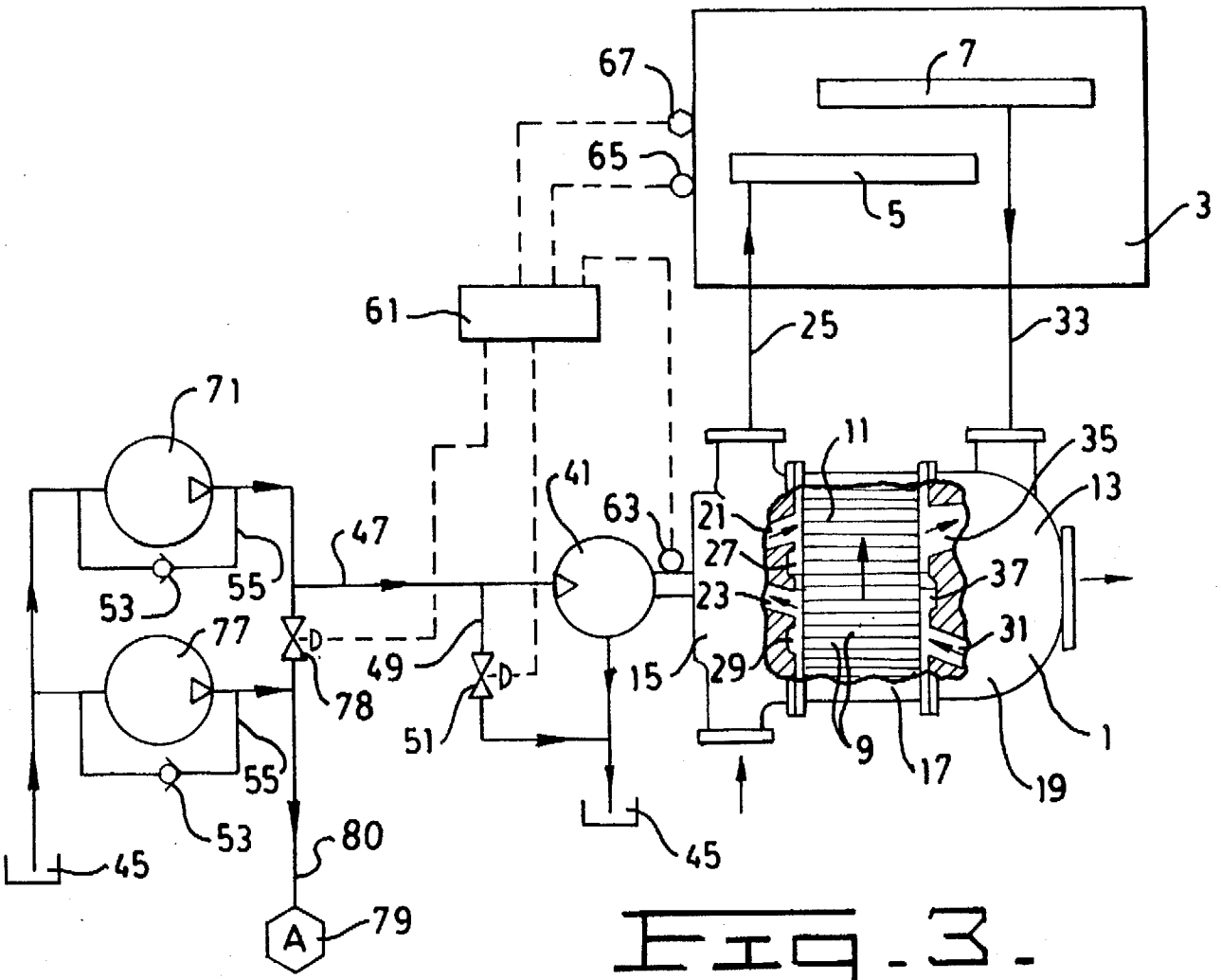
FIG. 3 is a schematic view of another alternative hydraulic drive system for a pressure wave supercharger utilized with an internal combustion engine made in accordance with this invention.

Referring now to FIG. 3 in detail, the supercharger 1, the engine 3, the hydraulic motor 41 and the controller 61 are the same as described in FIG. 2, the difference in the figures being that in FIG. 3 there are two hydraulic pumps, a main hydraulic pump 71 and an accessory hydraulic pump 77 connected in parallel to the hydraulic conduit 47 to supply hydraulic fluid to drive the variable speed hydraulic motor 41. The main hydraulic pump 71 supplies hydraulic fluid to the variable speed hydraulic motor 41 during the entire time the engine 3 is operating and the accessory hydraulic pump 77 only supplies hydraulic fluid to the hydraulic motor 41 during engine startup. When the engine speed is such that the output of the main pump 71 is sufficient to operate the variable speed hydraulic motor 41 at required operating speeds, a valve 78 is closed to shut off the flow of hydraulic from the accessory pump 77 to the hydraulic motor 41. The accessory pump 77 is also disposed in fluid communication with a hydraulic engine accessory 79, such as a power steering unit, via an accessory conduit 80. The accessory pump 77 always supplies hydraulic to the accessory 79. However, during engine startup, the flow requirement of the accessory 79 is very low or nil. Thus, there is ample hydraulic fluid available from the output of the accessory pump 77 to startup the variable speed hydraulic motor 41 and the main pump 71 need only be sized to provide hydraulic fluid to operate the hydraulic motor 41 and drive the rotor 11 of the supercharger 1 when the engine 3 is running at idle speed.

Figure 4:
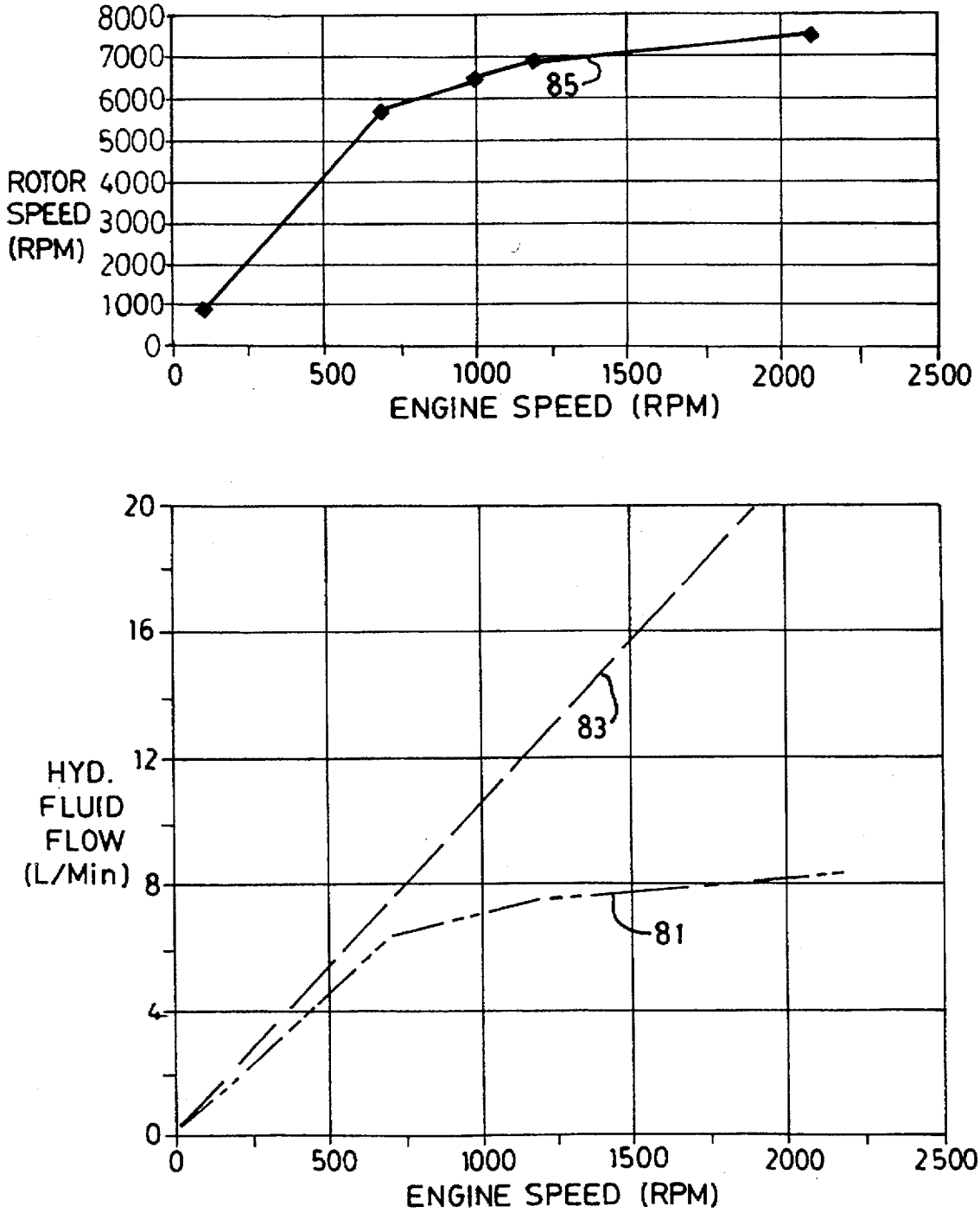
FIG. 4 shows two graphs relating to the hydraulic drive system shown in FIG. 1, the lower graph shows engine speed verses hydraulic fluid flow for a pump and a motor which form the hydraulic drive system and the upper graph shows engine speed verses supercharger rotor speed.

FIG. 4 shows engine speed in RPM verses hydraulic fluid flow in liters per minute for the hydraulic variable speed motor 41 in FIG. 1 in the curve 81 and for the hydraulic pump 43 in FIG. 1 in the curve 83. It should be noted, in FIG. 4, that the output of the hydraulic pump 43 always exceeds the requirement of the variable speed hydraulic motor 41.

FIG. 4. also shows engine speed verses rotor speed for FIG. 1 in curve 85. It should be noted that the rotor speed is tuned to the engine speed, whereby the pressure wave supercharger 1 will operate at maximum efficiency as the engine 3 operates at various speeds and loads.

Figure 5:
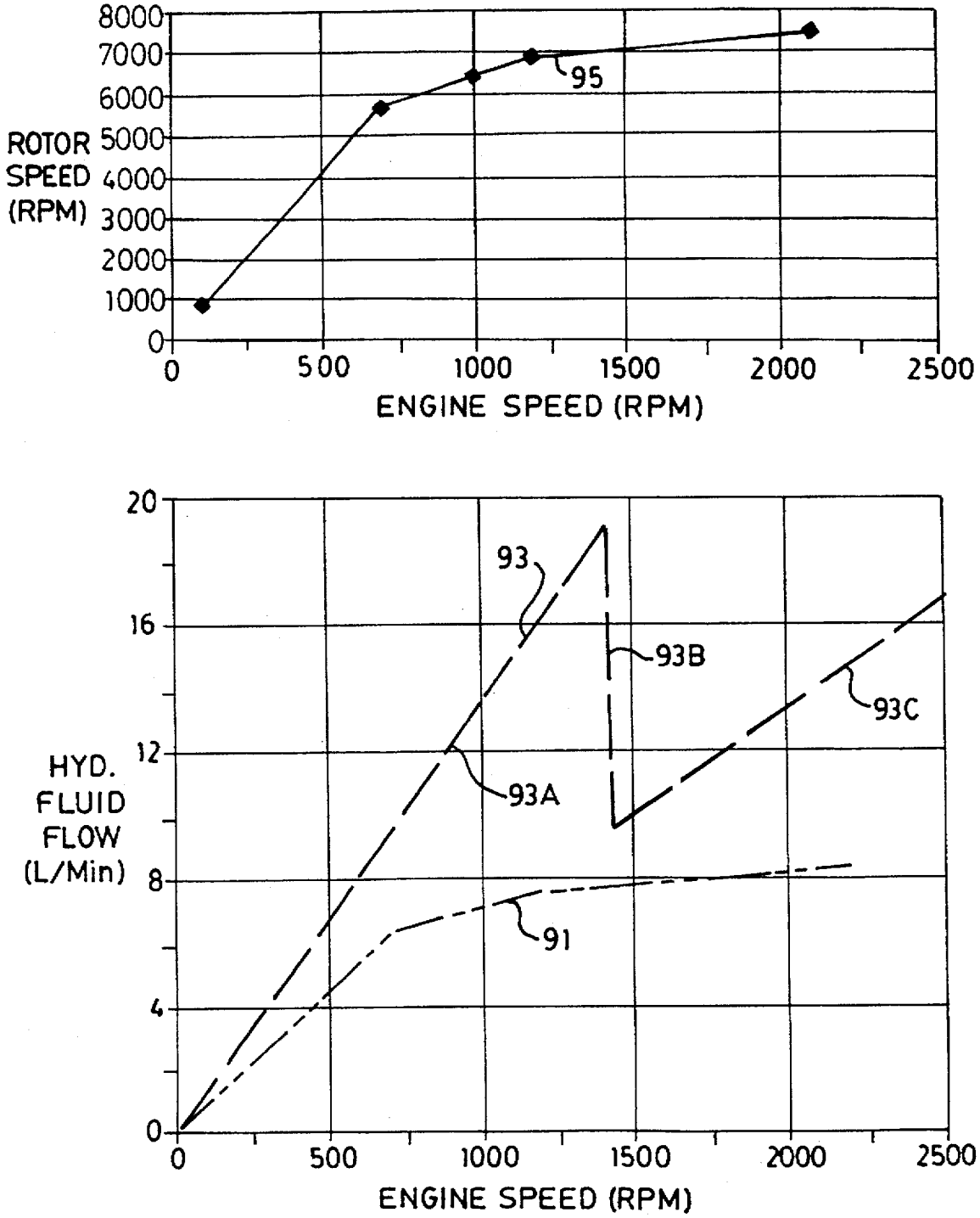
FIG. 5 shows two graphs relating to the hydraulic drive system shown in FIG. 2 the lower graph shows engine speed verses hydraulic fluid flow for pumps and a motor which form the hydraulic drive system and the upper graph shows engine speed verses supercharger rotor speed.

FIG. 5 shows engine speed in RPM verses hydraulic fluid flow in liters per minute for the hydraulic variable speed motor 41 in FIG. 2 in the curve 91 and for the main hydraulic pump 71 and the auxiliary hydraulic pump 73 in FIG. 2 in the curve 93. It should be noted, in FIG. 5, that the combined output of the main hydraulic pump 71 and the auxiliary hydraulic pump 73 is shown by a left portion 93A of the curve 93 and there is a step 93B when the flow from the auxiliary pump 73 is shut off due to the valve 75 closing and a right portion 93C of the curve 93 shows just the output of the main hydraulic pump 71. The output of the pumps 71 and 73 going to the motor 41 always exceeds the requirement of the variable speed hydraulic motor 41.

FIG. 5. also shows engine speed verses rotor speed for FIG. 2 in curve 95. It should be noted that the rotor speed is tuned to the engine speed, whereby the pressure wave supercharger 1 will operate at maximum efficiency as the engine 3 operates at various speeds and loads.

Figure 6:
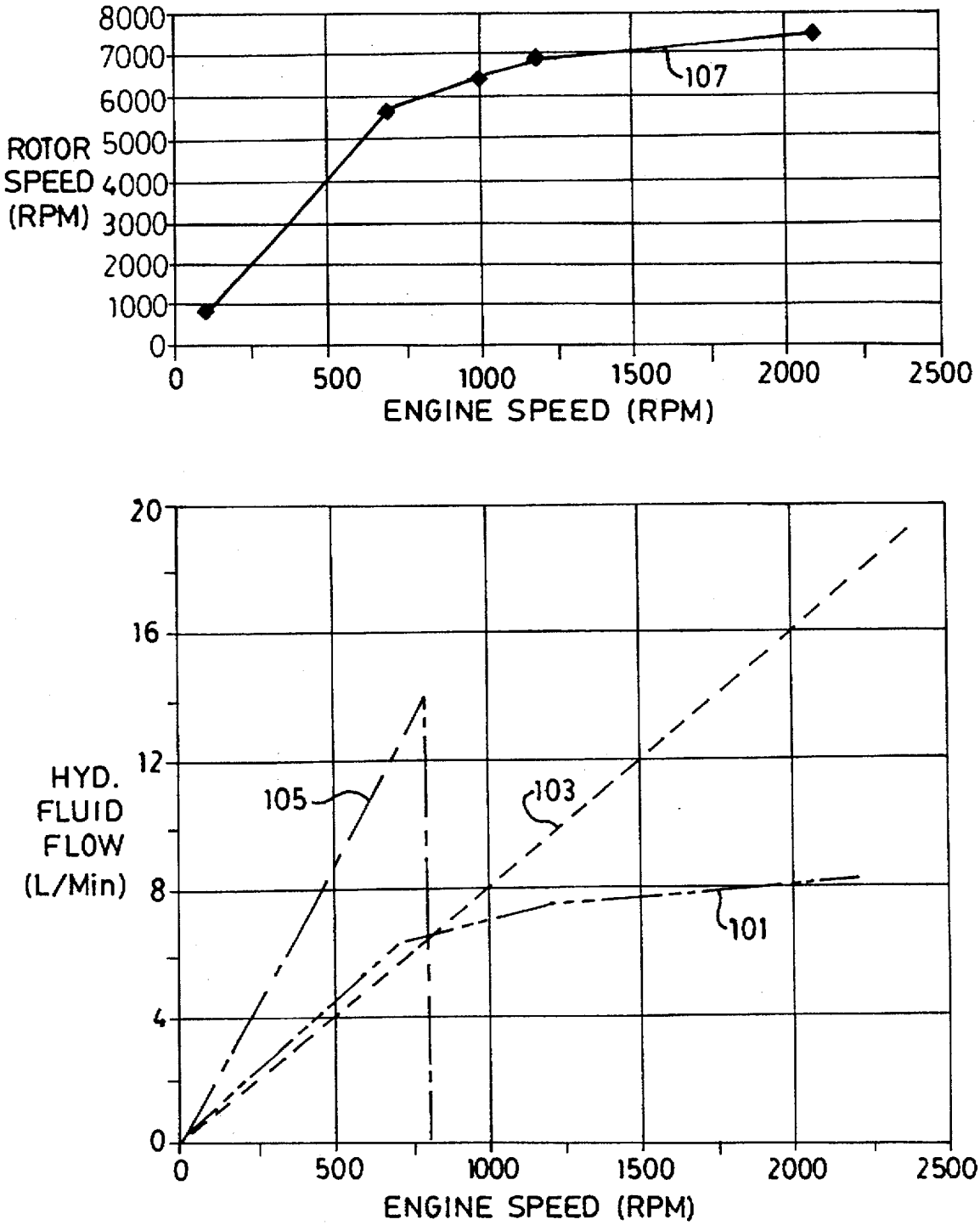
FIG. 6 shows two graphs relating to the hydraulic drive system shown in FIG. 3 the lower graph shows engine speed verses hydraulic fluid flow for pumps and a motor which form the hydraulic drive system and the upper graph shows engine speed verses supercharger rotor speed.

FIG. 6 shows engine speed in RPM verses hydraulic fluid flow in liters per minute for the hydraulic variable speed motor 41 in FIG. 3 in the curve 101, for the main hydraulic pump 71 in FIG. 3 in the curve 103 and the excess fluid flow of the accessory hydraulic pump 77 in FIG. 3 in the curve 105. It should be noted, in FIG. 6, that the combined fluid flow from the accessory hydraulic pump 77 and from the main hydraulic pump 71 is more than sufficient to operate the variable speed hydraulic motor 41 until the engine reaches low speed idle at which time the engine auxiliary 80 becomes operable and requires the total output of the accessory pump 77. The output of the main hydraulic pump 71 as shown by the curve 103 is not sufficient to operate the variable speed hydraulic motor at the desired speed until the engine reaches low idle speed at which time the excess flow from the accessory pump is not needed and the valve is shut off and the variable speed hydraulic motor can be driven at the proper speed by the output of main pump 71.

FIG. 6. also shows engine speed verses rotor speed for FIG. 3 in curve 107. It should be noted that the rotor speed is tuned to the engine speed, whereby the pressure wave supercharger 1 will operate at maximum efficiency as the engine 3 operates at various speeds and loads.

While the preferred embodiments described herein set forth the best mode to practice this invention presently contemplated by the inventors, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

INDUSTRIAL APPLICABILITY

The pressure wave supercharger 1 is particularly applicable to internal combustion engines 3 which are utilized to power machines as the pressure wave supercharger 1 has extremely fast response time. A dependable and economical variable speed hydraulic drive system for the pressure wave supercharger 1, which will optimize performance of the engine 3 as it operates at various speeds and loads, makes the system economically viable.

What is claimed is:

1. An hydraulic drive system for a pressure wave supercharger comprising a housing, a circular array of a plurality of elongated chambers forming a rotor, which is rotatably disposed within the housing, the pressure wave supercharger being cooperatively associated with an internal combustion engine to compress incoming combustion air supplied to the engine, characterized by a hydraulic motor coupled to the rotor to rotate the rotor relative to the housing, a first hydraulic pump driven by the engine for providing pressurized hydraulic fluid to the hydraulic motor to drive the motor when the engine is running, a second hydraulic pump for providing pressurized hydraulic fluid to the hydraulic motor to drive the motor, a flow control valve for controlling the flow of hydraulic fluid flowing from the first and second hydraulic pumps to the hydraulic motor, means for shutting off the flow of hydraulic fluid from the second to the hydraulic motor, and a controller which operates the flow control valve to regulate the hydraulic fluid provided to the hydraulic motor and control the speed of the rotor to synchronize the pressure wave action within the elongated chambers of the rotor and supply combustion air to the engine at the proper volume and density and which operates the means for shutting off the flow of hydraulic fluid from the second hydraulic pump to the hydraulic motor when the engine is operating above a predetermined speed, whereby the first pump provides hydraulic fluid to the hydraulic motor when the engine is operating and the second pump only provides hydraulic fluid to the hydraulic motor when the engine speed is below the predetermined speed.

2. A hydraulic drive system as set forth in claim 1, further characterizes in that the second hydraulic pump also supplies hydraulic fluid for a hydraulic engine accessory once the engine has reached the predetermined speed.

3. A hydraulic drive system as set forth in claim 2, further characterized in that the controller operates the flow control valve to control the speed of the hydraulic motor in response to engine speed and at least one of the other engine operating conditions, which comprise fuel rate, boost pressure, intake manifold temperature, and throttle position.

4. A hydraulic drive system as set forth in claim 1, further characterized in that the controller operates the flow control valve to control the speed of the hydraulic motor in response to engine speed and at least one of the other engine operating conditions, which comprise fuel rate, boost pressure, intake manifold temperature, and throttle position.

* * * * *

UNITED STATES PATENT AND TRADEMARK OFFICE

CERTIFICATE OF CORRECTION

PATENT NO. : 5,724,949

DATED : March 10, 1998

INVENTOR(S) : Cho Y. Liang

It is certified that error appears in the above-identified patent and that said Letters Patent is hereby corrected as shown below:

Please correct Claim 1 as follows:

Column 5, line 30, change "An hydraulic" to "A hydraulic"

Column 6, line 6, delete "pumps" and insert --pump--

Column 6, line 7, insert --pump-- after the word "second"

Signed and Sealed this

Twenty-sixth Day of May, 1998

Bruce Lehman

BRUCE LEHMAN

*Commissioner of Patents and Trademarks*

*Attest:*

*Attesting Officer*